United States Patent [19]

French

[11] 4,123,909

[45] Nov. 7, 1978

[54] TURBINE TRIP SYSTEM

[75] Inventor: Charles T. French, Windsor, Conn.

[73] Assignee: Combustion Engineering, Inc., Windsor, Conn.

[21] Appl. No.: 752,759

[22] Filed: Dec. 20, 1976

[51] Int. Cl.[2] ..... F01K 13/02

[52] U.S. Cl. ..... 60/646; 60/644; 60/657; 415/17; 176/38

[58] Field of Search ..... 60/644, 646, 657, 661, 60/664, 665, 667; 415/17; 176/20, 38

[56] References Cited

U.S. PATENT DOCUMENTS

| | | | |
|---|---|---|---|
| B 557,153 | 2/1976 | Wonn et al. | 60/657 X |
| 3,247,069 | 4/1966 | Powell et al. | 176/20 R |

*Primary Examiner*—Allen M. Ostrager

*Assistant Examiner*—Stephen F. Husar

*Attorney, Agent, or Firm*—Joseph H. Born; Richard H. Berneike

[57] ABSTRACT

An improved high-water-level trip control for a steam turbine is disclosed. Instead of causing a trip of the turbine (or reactor) based merely on the water level in the steam generator, the present invention generates a trip command that is based on a function of more than one parameter. Such a function more accurately indicates the quantity of water droplets in the steam leaving the steam generator than a function of a single parameter does. In particular, it is disclosed to trip the turbine when the water level exceeds a variable reference that increases as steam velocity decreases; this takes into account the effect of steam velocity on the entrainment of water droplets by the steam.

6 Claims, 2 Drawing Figures

TURBINE TRIP SYSTEM

BACKGROUND OF THE INVENTION

In pressurized-water nuclear reactors primary coolant, which is heated by the reactor itself, is sent to a steam generator in which it is employed to heat a secondary coolant, a coolant that is physically but not thermally isolated from the primary coolant. The secondary coolant is typically water, and it is turned to steam by heat from the primary coolant. The steam turns a turbine, which drives an electrical generator. It is the electrical generator that supplies power to the power lines.

It is a matter of some concern to the generator owner that almost no water droplets be carried by the steam into the turbine. Elimination of carryover is important because water droplets can cause quite costly mechanical damage to the turbines. As a result, some of the power companies that purchase steam-supply systems require that some provision be made for shutting down the turbine when it appears that water droplets will be entrained by the steam. Since it is known that there is a positive correlation between high steam-generator water level and water droplet carryover, the solution resorted to by the steam-generator vendor has typically been to measure the water level in the steam generator and trip, or remove the steam supply from, the turbine whenever the water level exceeds a predetermined height.

This system is ordinarily adequate, but it can present inconveniences. This is particularly true when both the turbine and the reactor must be shut down in response to a high-water-level condition. Once a reactor has been shut down, it is a matter of several hours before it can be brought on line again, and each hour of downtime constitutes an enormous expense to the power company.

SUMMARY OF THE INVENTION

Accordingly, it is an object of the present invention to reduce the number of trips that can be expected.

According to the present invention, the variables of a function of at least two variables are measured, the function being a closer approximation of the amount of water-droplet carryover than is the steam-generator water level alone. According to one embodiment, a trip occurs when the water level reaches a value that is a decreasing function of steam velocity. In this manner the system tolerates a higher water level at low steam velocities, thereby avoiding unnecessary trips.

BRIEF DESCRIPTION OF THE DRAWINGS

These and further features and advantages of the invention become evident in the description of the embodiment shown in the drawings attached, wherein.

DETAILED DESCRIPTION OF THE PREFERRED EMBODIMENT

Figure 1:
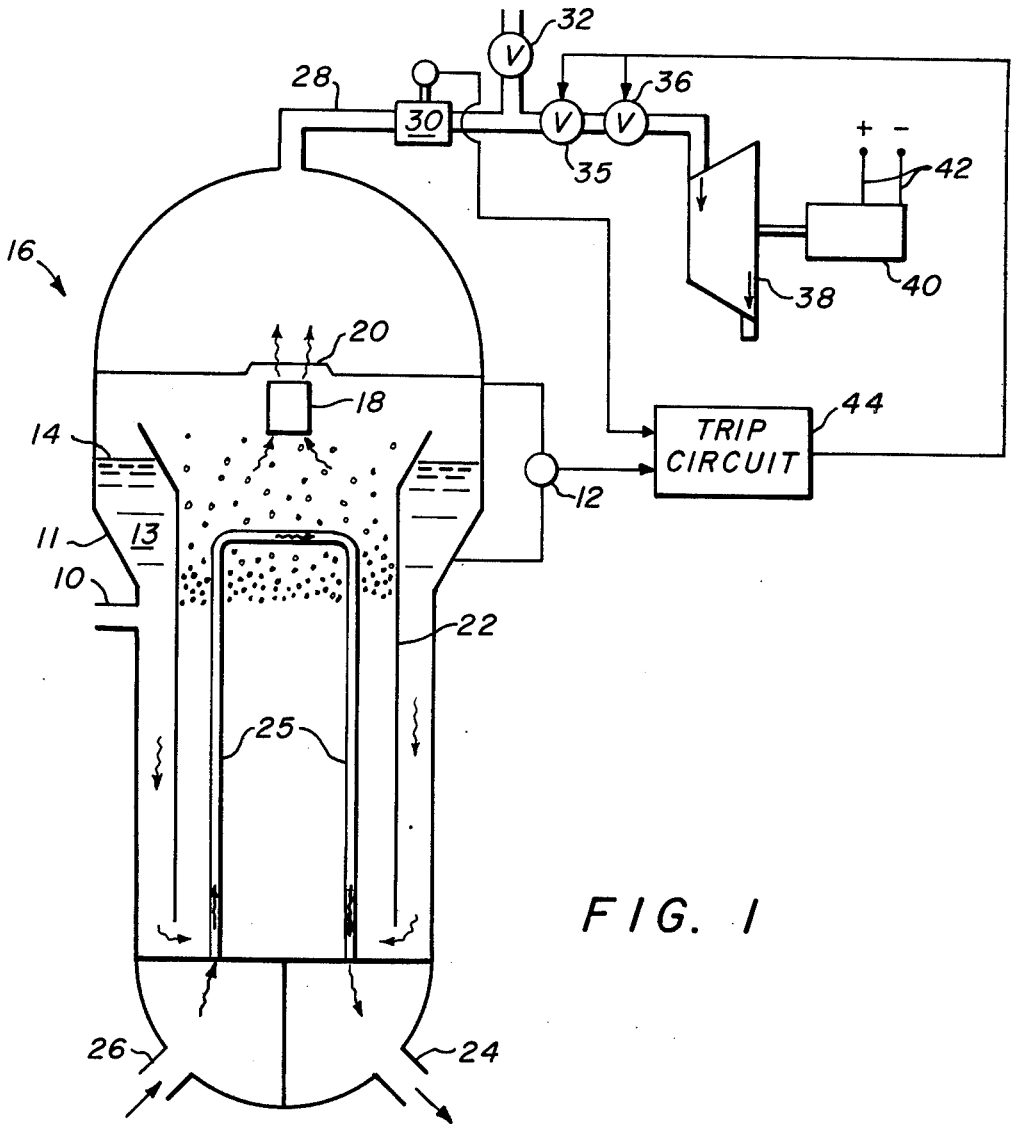
FIG. 1 is a diagrammatic representation of a steam generator and its connection to a turbine.

FIG. 1 illustrates the interconnection of a steam generator and turbine in a power plant. The steam generator, indicated generally as 16, contains liquid water to be vaporized, or secondary coolant up to a level 14. This water enters through annulus 13 formed by shell 11 and annular barrel 22. The construction of downcomer 13 is such that any water located in it must flow around the bottom of barrel 22 in order to reach the interior of barrel 22. The feedwater enters through conduit 10, flows down annulus 13, where it joins secondary coolant that has been recirculated, and flows up into the interior of barrel 22. There it is heated by U-shaped steam-generator tube 25. In this simplified version, only one steam-generator tube is shown, but a large number of them are included in a typical steam generator. Primary coolant, liquid that has been heated by the nuclear reactor, enters steam-generator tube 25 through inlet 26. In flowing through steam-generator tube 25, it gives up its heat to the secondary coolant. It then leaves through outlet 24. In the process, the secondary coolant is heated to its boiling point, causing a mixture of liquid water and steam to be present in the upper regions of the interior of barrel 22. Elements 18 and 20, known in the art as a separator and a drier, respectively, are means for separating the liquid water from the steam and returning the liquid water to annulus 13. This separation leaves very dry steam that exits through conduit 28 and flows through turbine 38, causing it to rotate. The rotation of turbine 38 causes rotation in generator 40, which generates electricity that is sent out by means of power lines 42.

Though the turbine and generator are both required to run at a constant speed while they are in operation, the load, or amount of current that flows in lines 42, changes according to how many light bulbs, irons, television sets, etc., are being powered by the generator. The amount of force required to turn the generator increases as the load increases, so when a large load is on generator 40, a high steam velocity must be present in conduit 28 to maintain the required speed of rotation in turbine 38. In some cases, generator 40 will be operated at a constant load, and other generators will be required to respond to whatever variations occur in the load. However, if it is generator 40 that must respond to sudden load changes, a problem can be caused in the steam generator. A sudden reduction in force is experienced by generator 40 when a large part of its load is suddenly dropped from it, and this results in a tendency for turbine 38 to suddenly increase its speed. Since the power company must keep the speed constant, means not shown in FIG. 1 operate turbine admission valve 36 to reduce the amount of steam entering turbine 38, thus regulating the speed of rotation of turbine 38. Simultaneously, other means such as turbine bypass valve 32 operate to cause the steam that has been blocked by valve 36 to flow around turbine 38. However, this operation is not completely smooth, and a pronounced transient in steam-flow rate usually results at the exit of steam generator 16, sometimes causing swells in water level 14. (Such transients and the accompanying swells can also be caused by sudden increases, as well as decreases, in load.) If the water level resulting from the swell is greater than a predetermined level, the turbine will be caused to trip, which means that valves 35 and 36 are closed, removing the steam supply from the turbine. This steam-supply removal is effected in order to protect the turbine from the water droplets that are often carried by the steam when the water level is high. Generator 40 is removed from the power lines as a result of the trip, and the power company must buy power from other utilities in order to keep the voltage from dropping. This is not ordinarily desired by the power company.

The apparatus of the present invention makes it possible to avoid some of these trips. Trip circuit 44 receives the output of steam-generator level indicator 12, typically a differential pressure sensor, and it uses this output, as does the prior art, to determine whether or not to generate a turbine trip signal. However, unlike the prior art, trip circuit 44 also receives an indication of steam velocity from flowmeter 30. The circuitry of trip circuit 44 takes into account the steam velocity because the amount of liquid-water carryover is dependent not only upon steam-generator water level but also upon the velocity at which the steam leaves the steam generator. Consequently, the water level that is sufficient to cause trip circuit 44 to generate a trip signal is a function of the steam velocity; when the steam velocity is relatively low, the water level required to cause a trip is relatively high. Since the steam velocity is sometimes low when a transient occurs, the reactor and generator 40 often will not trip, because trip circuit 44 takes into account the low steam velocity.

Figure 2:
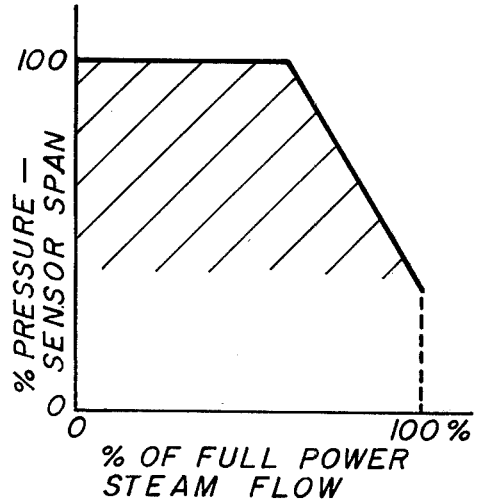
FIG. 2 is a graph showing the relationship of steam velocity to trip level in an embodiment of the invention illustrated in the present specification.

The relationship shown in FIG. 2 is an example of how water level and steam velocity might be used. Steam velocity is determined by measuring the steam flow in conduit 28. This is expressed as a percentage of full-power steam flow. All levels are expressed as a fraction of the span between the levels at which pressures are sensed by indicator 12. Given the relationship in FIG. 2, unacceptable carryover might be experienced when water level is only slightly above the bottom of separator 18 if the flow rate is at 100 percent of capacity. This would be the typical trip level in prior-art systems. However, as the rate of steam production is reduced, the water level that could be tolerated increases, but prior-art systems would still generate a trip whenever the water level exceeds the trip level indicated for 100 percent of capacity. It can therefore be seen that the shaded area in FIG. 2 represents a range of operation that is possible with the present system but that would cause a trip in prior-art systems.

Those skilled in the art will recognize that trip circuit 44 will exhibit the linear portion of the FIG. 2 relationship if it is a circuit of the type that produces an output (trip signal) whenever the sum of a quantity proportional to its first input (the level indication) and a quantity proportional to its second input (the steam-velocity indication) exceeds a predetermined value. An operational amplifier followed by a Schmitt trigger, for example, would be such a circuit.

While the present invention is described in terms of a specific embodiment, it will be evident to those skilled in the art that many modifications and adaptations of the present invention could be made without departing from the spirit of the invention. Accordingly, it is meant to include all such modifications and adaptations as fall within the scope of the appended claims.

What is claimed is:

1. A method of protecting a turbine from liquid-water carryover, the turbine being fed by emissions from a steam generator containing water that is heated in the steam generator to produce steam, the amount of carryover being determined by at least one function of the steam-generator water level and the velocity of steam leaving the steam generator to flow to the turbine, comprising the steps of:

a. determining the values of steam-generator water level and steam velocity; and b. preventing the emissions from reaching the turbine when the value of the function as defined by the determined values of steam-generator water level and steam velocity exceeds a predetermined level.

2. A method as recited in claim 1 wherein the step of preventing emission from reaching the turbine comprises preventing the emissions from reaching the turbine when the sum of a quantity proportional to the velocity and a quantity proportional to the water level exceeds a first predetermined level.

3. A method as recited in claim 2 wherein the emissions are also prevented from reaching the turbine whenever the determined value of water level exceeds predetermined second level, regardless of the determined value of steam velocity.

4. An apparatus for tripping a turbine in order to protect it from liquid-water carryover, the turbine being fed by emissions from a steam generator containing water that is heated in the steam generator to produce steam, the amount of carryover being determined by at least one function of the steam-generator water level and the velocity of the steam leaving the steam generator to flow to the turbine, comprising:

a. means for generating a first signal indicative of the steam-generator water level;

b. means for generating a second signal indicative of the steam velocity; and c. means, connected to receive the signals, for tripping the turbine when the value of the function at the values of water level and steam velocity indicated by the signals exceeds a predetermined value.

5. An apparatus as recited in claim 4 wherein the trip means comprises means for tripping the turbine when the sum of a quantity proportional to the level indicated by the first signal and a quantity proportional to the velocity indicated by the second signal exceeds a predetermined first value.

6. An apparatus as recited in claim 5 wherein the trip means also trips whenever the water level indicated by the first signal exceeds a predetermined second level, regardless of the steam velocity indicated by the second signal.

* * * * *